US008316623B2

(12) United States Patent
Naroska

(10) Patent No.: US 8,316,623 B2
(45) Date of Patent: Nov. 27, 2012

(54) METHOD AND APPARATUS FOR FORMING A SEALED SEAM BETWEEN A TEAR-OFF FILM AND A PACKAGING MEMBER

(75) Inventor: Marcus Naroska, Bad Salzuflen (DE)

(73) Assignee: Rainer Naroska Verpackungsmaschinen GmbH & Co. KG, Bad Salzuflen (DE)

( * ) Notice: Subject to any disclaimer, the term of this patent is extended or adjusted under 35 U.S.C. 154(b) by 316 days.

(21) Appl. No.: 12/830,555

(22) Filed: Jul. 6, 2010

(65) Prior Publication Data

US 2011/0005175 A1 Jan. 13, 2011

(30) Foreign Application Priority Data

Jul. 10, 2009 (EP) ..... 09009023

(51) Int. Cl.
*B65B 61/18* (2006.01)
*B65B 7/28* (2006.01)

(52) U.S. Cl. ..... 53/412; 53/487; 53/133.8; 53/296

(58) Field of Classification Search ..... 53/412, 53/487, 133.1, 133.3, 133.8, 290, 296; 156/581; *B65D 17/40, 77/38; B65B 61/18*
See application file for complete search history.

(56) References Cited

U.S. PATENT DOCUMENTS

| | | | | |
|---|---|---|---|---|
| 1,898,925 | A * | 2/1933 | Anderson | 53/412 |
| 4,948,441 | A | 8/1990 | Peck | |
| 5,141,594 | A * | 8/1992 | Walter et al. | 156/581 |
| 6,701,993 | B2 * | 3/2004 | Faherty | 156/581 |
| 2005/0199627 | A1 * | 9/2005 | Heinicke | 220/270 |

FOREIGN PATENT DOCUMENTS

| | | | |
|---|---|---|---|
| CH | 680422 | A5 | 6/1992 |
| DE | 3943538 | A1 * | 5/1991 |
| DE | 10324012 | A1 | 12/2004 |
| DE | 102005055197 | B3 | 10/2006 |
| EP | 0344340 | A1 | 12/1989 |
| EP | 0962398 | A1 | 12/1999 |
| EP | 1990281 | A2 | 11/2008 |

* cited by examiner

*Primary Examiner* — Stephen F Gerrity
(74) *Attorney, Agent, or Firm* — Richard M. Goldberg

(57) ABSTRACT

A method of forming a sealed seam between a tear-off film (12), that is provided with a tear-off strip, and a packaging member (14), the method including at least one sealing step, in which the packaging member (14) and the film 12 are compressed between a lower die (20) supporting the packaging member (14) and an upper die (22) such that an annular sealed seam (28) is formed in the peripheral portions of the film (12) and the packaging member (14), in which wherein, during a sealing step or in a subsequent non-sealing step, the sealing seam (28) is partly destroyed or weakened at is internal peripheral edge (30) in the vicinity of the tear-off strip.

11 Claims, 8 Drawing Sheets

METHOD AND APPARATUS FOR FORMING A SEALED SEAM BETWEEN A TEAR-OFF FILM AND A PACKAGING MEMBER

BACKGROUND OF THE INVENTION

The present invention relates to a method of forming a sealed seam between a tear-off film and a packaging member.

A large number of consumer products are offered in packages that are closed by a tear-off film. For example, cup-shaped containers are sealed with the film made of aluminum, plastics or a composite material. Typically, the sealing is achieved by introducing the packaging container and the film superposed thereon between two dies and compressing them between these dies, so that the meltable sealing layer of the film can form a welding-type joint with the edge of the packaging member.

In this sealing step, the upper die may for example be moved from above against the lower die that supports the packaging member, or the lower die is lifted against the upper die. A combination of such axial movements of the dies is also possible, as been described for example in EP 1 990 281 A2. In what follows, the terms upper die and lower die shall not be construed as limiting the orientation of the dies in space, but are merely motivated by the fact that the packaging member is conveniently arranged in the lower die. Moreover, the term "packaging member" shall designate both, packaging containers to be sealed, such as cups or the like, as well as parts thereof. For example, it is common practice that only a part of the package, e.g. an intermediate ring is sealed with a film in the way described above, and this intermediate ring is then joined to the rest of the package by crimping or any other method in order to form a container.

In the sealing step, a complete and continuous tight peripheral sealed seam is formed in the peripheral portions of the film and the packaging member. This sealed seam must be strong enough to reliably close-off the package. In a known method, for example, a first sealing step is followed by one or more further sealing steps in which the width of the sealed seam is increased or the bonding strength is improved by compressing the film and the packaging member once again. On the other hand, measures which improve the strength of the sealed seam, such as a widening of the seam, make the tear-off process more difficult. It is therefore desirable to form the seam in such a way that, on one hand, it can withstand a high internal pressure and, on the other hand, the necessary tear-off forces are reduced.

In an initial phase of an opening process, the largest tear-off forces will generally occur at the tear-off strip. When, for example, an arcuate seam is exposed to tearing forces from outside, the length of the tear-off front increases rapidly in the direction transverse to the tear-off direction, i.e. over the width of the package. It is possible to reduce the tear-off forces by means of notch-like or arcuate cut-outs in the outer edge of the welded seam, as has been disclosed for example in EP 0 344 340 A1 and CH 680 422 A5. The solutions disclosed in these documents concentrate mainly on the reduction of the forces in the initial phase of tearing-off the seam and not on a reduction of the maximum tear-off force. The latter is frequently increased by bulges of the sealing material at the edges of the seam, which bulges result from the effect that, when the packaging element and the film are compressed, sealing material is displaced towards the inside and towards the outside of the package. In the vicinity of the bulges, the sealing strength is particularly high and must unfortunately be overcome in the very moment in which the tear-off front reaches the maximum length across the sealed seam. The problems resulting from this effect are neither addressed nor solved in the prior art cited above.

SUMMARY OF THE INVENTION

It is therefore an object of the present invention to improve a method of sealing a tear-off film on a packaging member such that the maximum tear-off force in the process of tearing-off the film is reduced without any need for substantial changes in the geometry of the sealed seam or the shapes of the die surfaces of the dies for compressing the packaging member and the film. More particularly, it is an object of the invention to prevent the maximum tear-off force from being increased additionally by bulges of sealing material in the internal edge area of the sealed seam.

Another object is to provide an apparatus for forming a sealed seam between a tear-off film and a packaging member that fulfills the objectives that have been set out above.

According to the invention, these objects are achieved with the method and apparatus of the present invention.

In the method according to the invention, the sealed seam is partly destroyed or weakened at its internal edge during a sealing step or during a subsequent non-sealing step in which the packaging member and film are compressed between the upper and lower dies. Thus, the coherence between the film and the packaging member is at least weakened to a considerable extent in this internal edge region, preferably in the peripheral portion where the tear-off strip is arranged, or the coherence is completely cancelled in a part of the area of the sealed seam that extends radially from the internal edge into the seam.

This partly destruction or weakening of the sealed seam can be achieved by several measures.

According to a preferred embodiment, the film in an inner peripheral portion of the sealed seam is bulged or lifted towards the top side that faces away from the packaging member, during or after a sealing step.

This bulging or lifting of the film from a condition where the film rests flat on the packaging member has the effect that the contact between the film and the packaging member at least at the internal periphery of the sealed seam is at least weakened. The bulging or lifting is effected after the sealed seam has been formed completely. As a result, the partly destruction of the seam proceeds from the internal periphery, and the cohesion between the film and the packaging member is at least weakened at the internal periphery of the sealed seam.

Preferably, the bulging or lifting is achieved by applying a mechanical pressure against the bottom side of the film.

This mechanical pressure is preferably applied by means of a plunger provided on the lower die.

According to a preferred embodiment, the plunger is arranged to be moveable in the lower die and to be lifted towards the upper die by means of a lift mechanism.

This moveable arrangement of the plunger permits to lift the internal area of the film during a sealing step. In this case, the film is first superposed in a flat condition on the packaging member and pressed thereagainst, whereby a continuous annular seal is formed. The bulging of the film is effected immediately thereafter while the die is still closed. This is achieved by means of a drive mechanism which presses the plunger from below against the internal area of the film and thereby partly destroys or weakens the sealed seam at its internal periphery.

In another preferred embodiment, the plunger is fixed in the lower die. This embodiment is used when at least one sealing step has been performed before.

In this case, the fixed plunger may have a height that is higher than the die surface of the lower die, so that the plunger projects upwardly beyond the die surface. Thus, when the packaging member and the film are compressed, the top end of the plunger lifts an internal portion of the film relative to the outer peripheral portion. The sealed seam that has been formed in the preceding sealing step is thereby at least partly destroyed or weakened in this peripheral area.

According to yet another preferred embodiment, the mechanical pressure is generated by applying a high gas pressure to the bottom side of the film or a low gas pressure to the top side.

In this case, a differential pressure is generated which causes the film to bulge. The lower die may in this case be provided with a gas supply port for applying pressure to the interior of the lower die. As an alternative, a vacuum pressure may be generated in the upper die for sucking the top side of the film, so that the necessary differential pressure between the lower die and the upper die is provided.

According to yet another preferred embodiment, during or after a sealing step, a plunger provided in the upper die is used for applying a mechanical pressure onto the top side of the film in the internal peripheral region of the sealed seam, preferably in the peripheral portion where the tear-off strip is arranged.

In this case, the mechanical pressure of the plunger may act to press sealing material out of the internal peripheral area of the sealed seam, so that the bonding strength is reduced in this area. Bulges of the sealing material in the internal peripheral area of the sealed seam can thereby be pressed inwardly to such an extent that they have to be ruptured only after the maximum length of the tear-off front has been reached, so that the force-enhancing effect is avoided. The plunger in the upper die may in this case be flush with the die surface while, in radially inward direction, it follows the contour of the surface of the packaging member beyond the width of the sealed seam, so that the sealing material is displaced as far as possible towards the interior of the package and is distributed over a larger surface area, respectively.

In an apparatus for sealing the tear-off film onto a packaging member according to the invention, one of the dies, i.e. the lower die or the upper die, is provided with a plunger adapted to press against the film near the internal peripheral edge of the die surface.

The plunger may be arranged directly at the internal peripheral edge of the die surface but may also be arranged spaced apart therefrom in an internal portion of the die. Depending on its arrangement and configuration, a plunger may provide for a pressure being applied to the bottom side of the film during or after the sealing step, which results in a partial destruction or weakening of the sealed seam at the internal peripheral edge thereof.

Advantageous embodiments of the apparatus are indicated in the dependent claims.

BRIEF DESCRIPTION OF THE DRAWINGS

Preferred embodiment examples of the invention will now being described in detail in conjunction with the drawings, wherein.

DETAILED DESCRIPTION

Figure 1A:
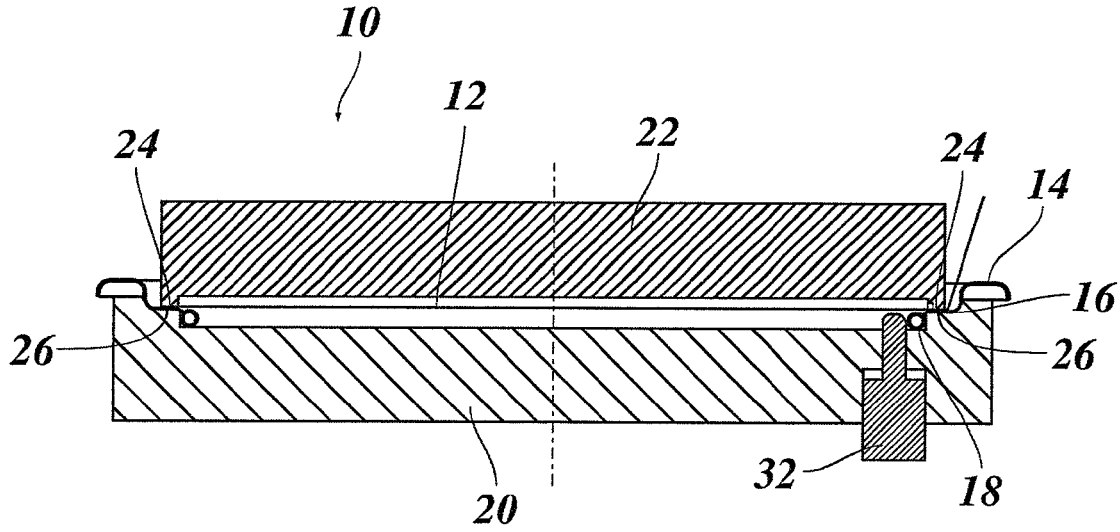
FIGS. 1*a* and 1*b* show a vertical cross-section of an apparatus for sealing the tear-off film onto a packaging member in accordance with an embodiment of the invention, suitable for carrying out a method according to the invention.
Figure 1B:
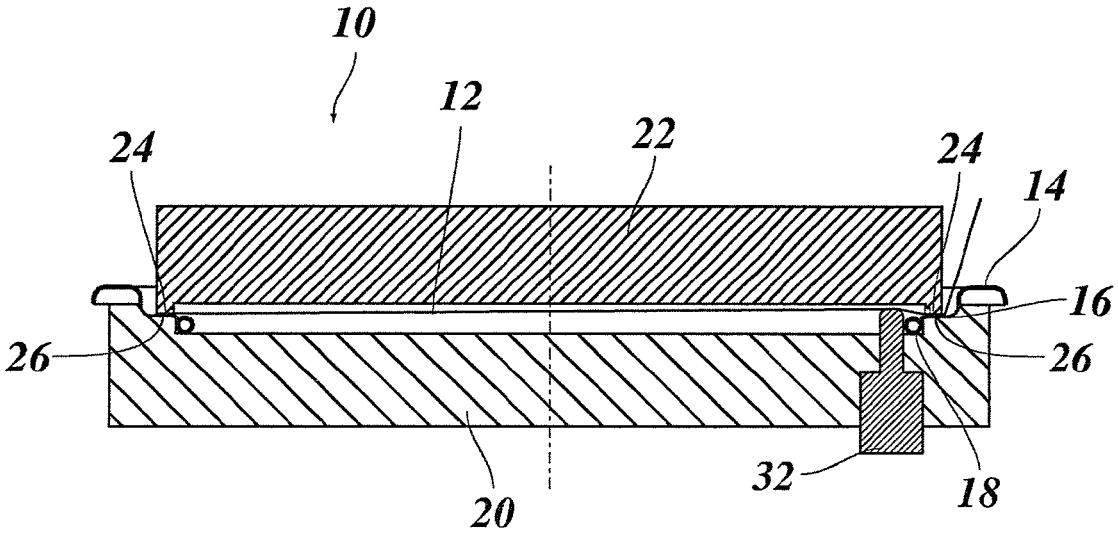

FIGS. 1*a* and 1*b* show a vertical cross-sectional view of a part of an apparatus for carrying out the method according to the invention for sealing a tear-off film 12 onto a packaging member 14. The packaging member 14 is a so-called intermediate ring that forms the upper edge of a packaging container. The essentially circular tear-off film 12 (see also FIG. 3) is sealed onto a flat edge portion 16 (see FIG. 2) of the intermediate ring 14 and, there, forms a welding-type bond with the intermediate ring 14. To that end, the film 12 is provided with a meltable coating on its bottom side. An internal edge portion 18 of the intermediate ring 14 is provided for forming, by means of crimping, a tight connection with a container that has not been shown here, so as to form a closed package. The packaging member in the meaning of the present invention may also be a complete packaging container or the like, so that the step of crimping the intermediate ring 14 to a cup member is eliminated.

Figure 2:
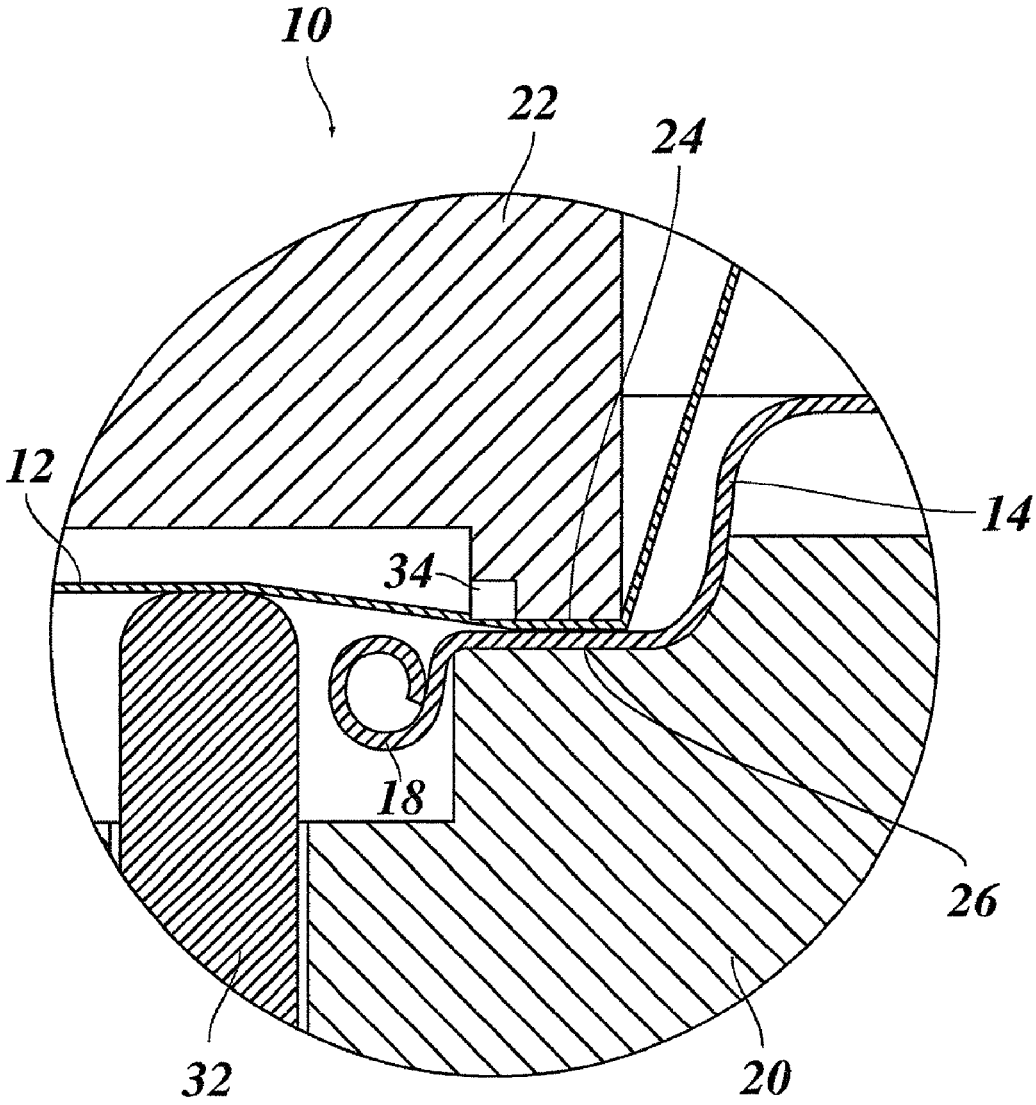
FIG. 2 shows a detail of FIG. 1*b;*

The apparatus 10 shown in FIGS. 1*a*, 1*b* and 2 comprises a lower die 20 and an upper die 22 which, in the arrangement shown here, is arranged above the lower die 20. The terms "lower die" 20 and "upper die" 22 shall not limit the invention to a certain geometrical arrangement of the two dies 20, 22 but refer only to a frequently used embodiment of that arrangement. In the following, the term "lower die" 20 shall designate any die that supports the packaging member, i.e. the intermediate ring 14. The upper die 22 is movable upwardly and downwardly in axial direction relative to the lower die 20. At its lower edge, the upper die 20 has an annular die surface 24 which serves for pressing the tear-off film 12 onto the edge portion 16 of the intermediate ring 14 so as to form a sealed seam in this area. The corresponding counter-surface 26 of the lower die 20 supports the edge portion 16 of the intermediate ring 14 from below when the film is pressed thereagainst and thus serves as a counter bearing. In the following, this surface 26 shall be designated as die surface of the lower die 20, because it is meaningless for the function of the apparatus whether the upper die 22 is lowered onto the lower die 20 or the latter is lifted against the upper die 22. A combined axial movement of the dies 20, 22 is also possible. What is important for pressing the film and the packaging member together is only that the dies 20, 22 can perform an axial linear movement towards one another, so that the die surfaces 24, 26 are pressed one against the other.

Figure 3:
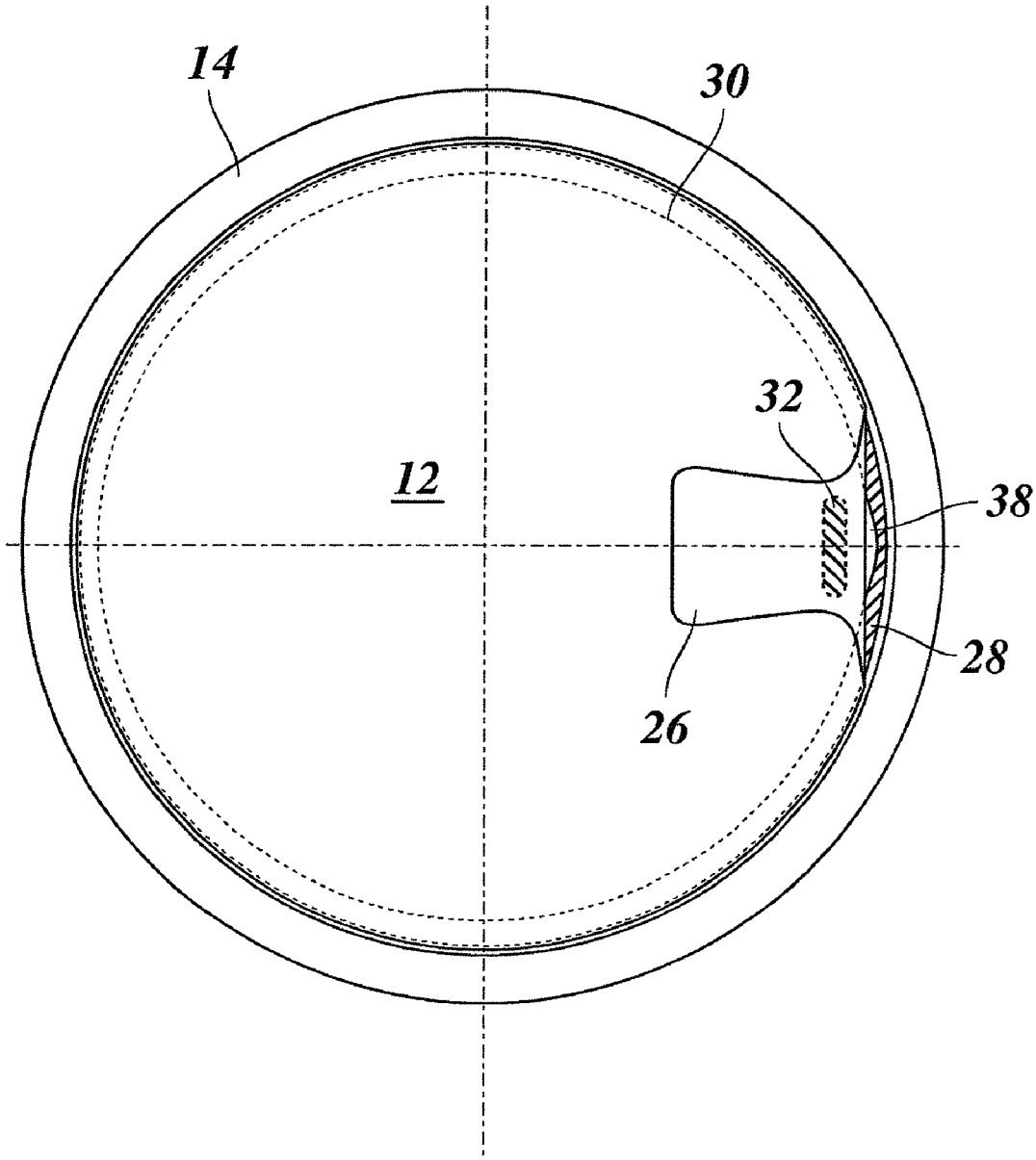
FIG. 3 shows a packaging member with a tear-off film sealed thereto, including a representation of the sealed seam formed in accordance with the invention.
Figure 4:
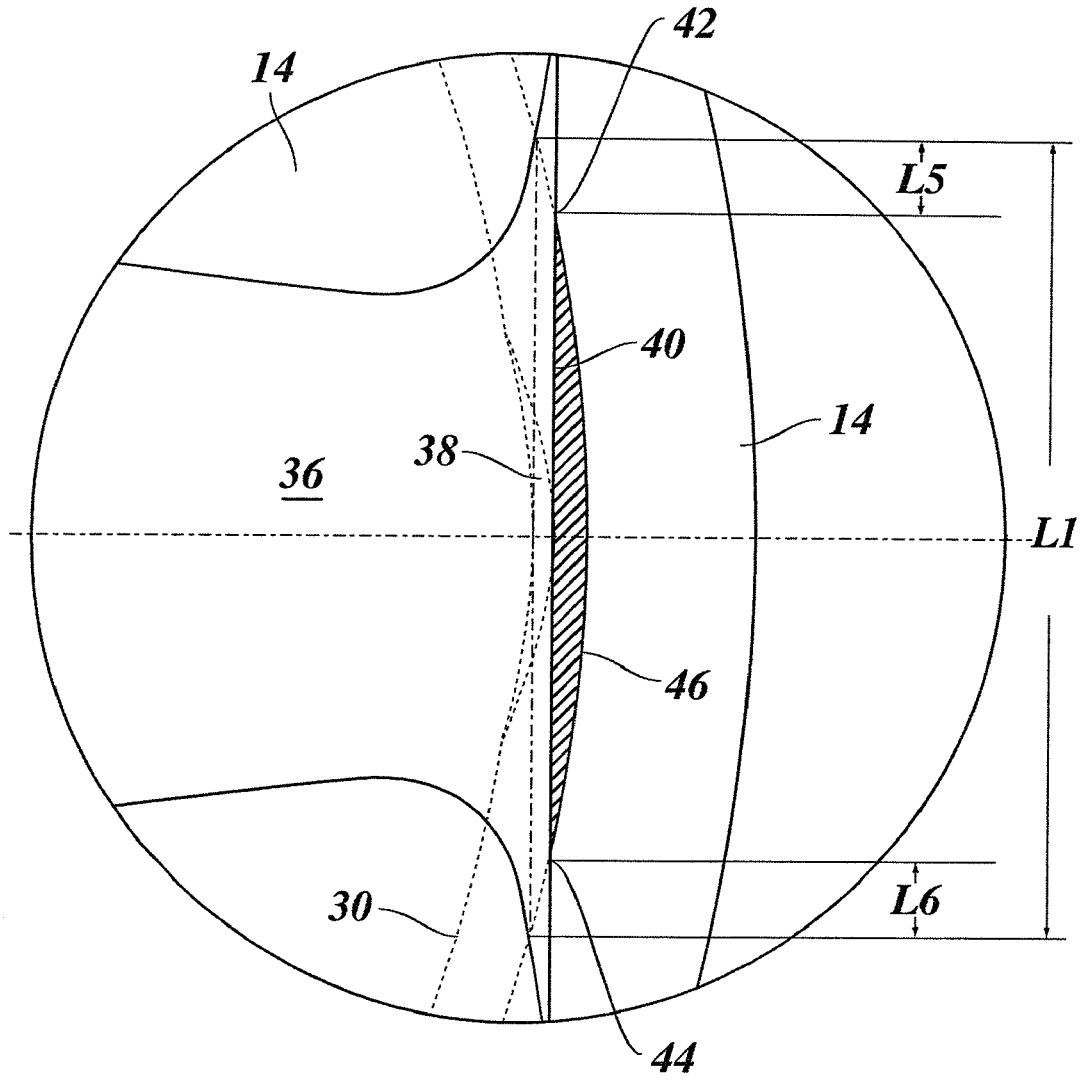
FIG. 4 shows a detail of a sealed seam, in the vicinity of the tear-off strip, formed by the method according to the invention.

In order to prepare for a sealing step, the intermediate ring 14 is inserted into the lower die 20 such that the edge portion 16 is supported on the die surface 26 of the lower die 20. The tear-off film 12 is commonly supplied to the top side of the intermediate ring together with the upper die 22 by lowering the latter. A preceding step of punching the tear-off film 12 from a larger blank has not been shown here. In the position shown in FIGS. 1 and 2, an annular continuous sealed seam 28, as shown in FIGS. 3 and 4, is formed by pressing the dies 20 and 22 against one another. This sealed seam 28 provides for a tight seal between the tear-off film 12 and the intermediate ring 14, as a result of melting of the seal material with which the bottom side of the tear-off film 12 is coated.

According to the invention, the sealed seam 28 is, during or after the sealing step in which the packaging member 14 and the film 12 are compressed between the lower die 20 and the upper die 22, partly destroyed or weakened at its internal edge 30 (see FIGS. 3 and 4). In the present embodiment, this destruction or weakening is achieved by a plunger 32 that is movably arranged in the lower die 20. The plunger 32 is movable upwardly and downwardly and can be moved, by means of a suitable drive mechanism, from a lowered position (FIG. 1*a*) in which it is lowered relative to the die surface 26 of the lower die 20, into a lifted position (shown in FIG. 1*b*).

This offers the possibility that the two dies 20,22 are at first pressed against one another in a sealing step, and only than, i.e. after the sealed seam 28 has been completed, the plunger 32 is lifted relative to the lower die 20 and pressed against the bottom side of the film 12. This results in a weakening of the seam 28 in the form of an arcuate recess 38 caused by the film 12 being bulged upwardly. When the plunger 32 is lifted, a part of the internal periphery 30 of the seam 28 that had been completed already is lifted-off again, i.e. the sealed seam 28 is partly destroyed in this area.

In the present embodiment, this is assisted by an arcuate recess 34 in the internal peripheral edge of the upper die surface 24 of the upper die 22 (shown in cross-section in FIG. 2). The recess 34 is present only in the peripheral portion of the upper die 22 which corresponds to the position of the plunger 32 in the lower die 20.

The shape of the sealed seam that is created in this process has been shown in FIGS. 3 and 4. As can particularly be seen in the representation in enlarged scale in FIG. 4, the upward bulge at the peripheral portion where the plunger 32 is located (as indicated in FIG. 3) creates an arcuate recess 38 at the internal peripheral edge 30 of the sealed seam 28, whereby the width of seam 28 is significantly reduced in this peripheral portion. The film 12 is oriented such that a tear-off strip 36 that is formed at this film is located at the position of the arcuate recess 38. Thus, the width of the sealed seam 28 is reduced at the tear-off position whereas it has a constant width in the remaining peripheral parts. As a result, the maximum tear-off force is reduced, as will be explained in conjunction with FIG. 4.

The amount of the force that is momentarily necessary for further tearing-off the strip 36 depends upon the resistance of the material that has to be overcome at this instant at the tear-off front 40 along which the contact with the seam 28 is just being released. This tear-off front 40 extends orthogonally to the tear-off direction and connects two points 42, 44 on the outer peripheral edge 46 of the seam 28. The tear-off force reaches its maximum at the point where the length of the tear-off front 40 is maximal. This situation has been illustrated in FIG. 4. When the film 12 is torn-off further beyond this point, the width of the seam 28 is exceeded at the point where the seam 28 is weakened by the arcuate recess 38 at its internal peripheral edge 30. When the film 12 is torn-off over the recess 38, the tear-off front is separated into two distinct fronts on both sides of the recess 38, and the total length of the tear-off front is reduced. Consequently, the tear-off force is reduced just in this moment.

In FIG. 4, L1 designates the maximum length of the tear-off front 40 for the case that the recess 38 at the internal peripheral edge of the seam 28 would not be present. This corresponds to the configuration of a sealed seam with constant width along its entire periphery, as it is known in the prior art. In contrast, in case of the present invention, the maximum length of the tear-off front 40 is reduced by the lengths L5 and L6. The tear-off force is reduced to this extent. In FIG. 4, the tear-off front 40 of maximum length that corresponds to the sealed seam 28 in accordance with the present invention is somewhat radially outwardly offset from the tear-off front of maximum length in the prior art. This means that the maximum of the tear-off force is reached somewhat earlier, but the amount of this force is smaller.

Figure 5:
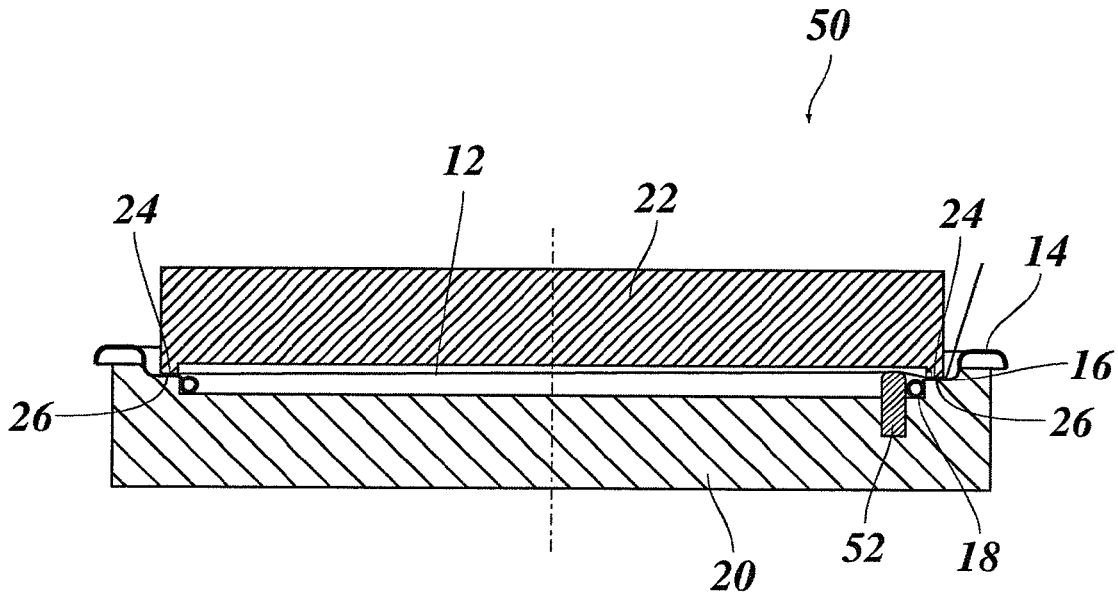
FIG. 5 shows another embodiment of an apparatus according to the invention in a view corresponding to FIG. 1*b;*

The embodiment of the apparatus 50 according to the invention that has been shown in FIG. 5 comprises also a lower die 20 and an upper die 22 for compressing an intermediate ring 14, serving a packaging member, and a tear-off film 12. While the upper die 22 is identical with the one shown in FIGS. 1*a*, 1*b* and 2, the lower die 20 is slightly modified. This lower die 20 is also provided with a plunger 52. However, in comparison to the first embodiment, this plunger 52 is arranged in a fixed position which essentially corresponds to the position of the movable plunger 32 in FIG. 2. The plunger 52 is slightly spaced apart from the internal peripheral edge of the die surface 26 of the lower die 20. Its height is so dimensioned that it slightly projects beyond the die surface 26. This has the consequence that, when the film 12 is pressed against the intermediate ring 14, the film is no longer held in a flat state between the dies 20, 22 but is slightly bulged upwardly at the position where the plunger 52 is present. The compression step according to this embodiment may be performed after a preceding sealing step in which the sealing seam has been formed. Thus, FIG. 5 illustrates a further processing stage that succeeds a sealing stage.

Figure 6:
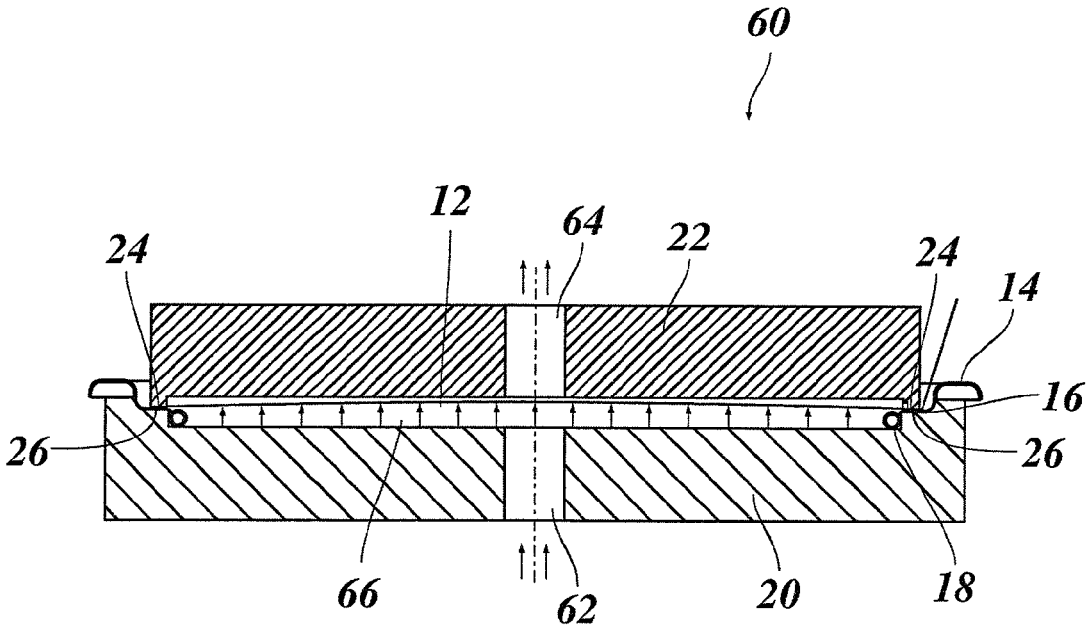
FIG. 6 shows another embodiment of the apparatus for carrying out the method according to the invention.

FIG. 6 shows another embodiment of the apparatus 60, wherein the lower die 20 has pressure supply passage 62 in its central portion, whereas the upper die 22 is provided with a suction passage 64. As it is shown in FIG. 6, an upward bulge of the film 20 can be achieved by applying pressure to the volume 66 below the part of the film 12 that is encircled by the seam 28 via the pressure supply passage 62. Alternative or in addition, a vacuum can be created on the top side of the film 20 via the suction passage 64. The pressure may be applied during the sealing step. In order for the sealing seam 28 to be weakened selectively only in a certain peripheral portion, a recess 34 may be formed in the upper die surface 24 of the upper die 22 in the desired position, similarly as in the embodiment shown in FIG. 2. Then, the film 12 will be released from the intermediate ring 14 in the area of the recess 34, so that the arcuate recess 38 is formed.

Figure 7:
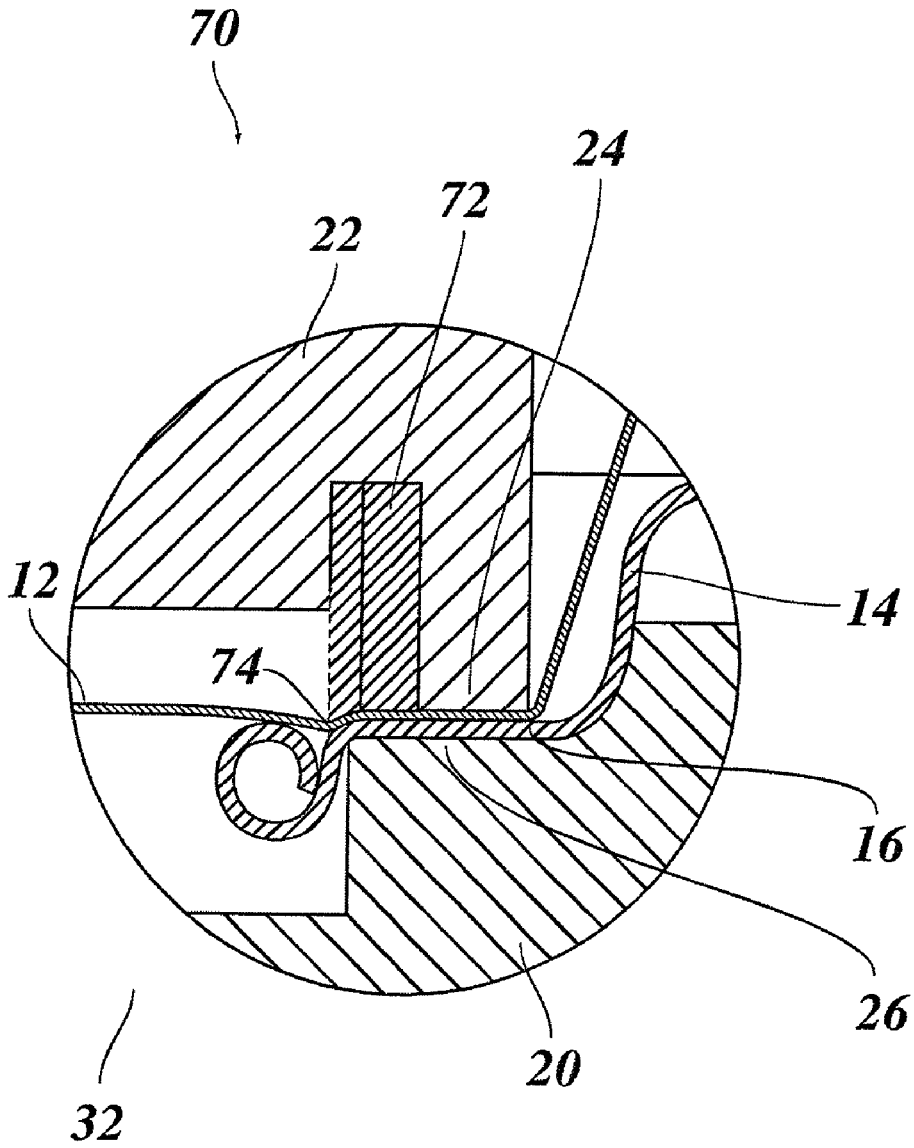
FIG. 7 shows a detail of an embodiment of the apparatus according to the invention.

In the embodiment 70 shown in FIG. 7, a plunger 72 is provided in the upper die 22. This plunger 72 is integrated into the internal peripheral edge of the die surface 24 and is flush with the bottom side of the die surface 24. In radial direction, the plunger 72 extends further inwardly than the internal peripheral edge of the die surface 24 in the other peripheral portions and follows the rounded shape of the internal edge of the contact surface 16 of the intermediate ring 14. Therefore, as is shown in FIG. 7, in the sealing step, the film 12 is slightly pressed downward by the radially inward bottom edge 74 of the plunger 72. Since the bottom side of the so-shaped plunger 72 follows the contour of the intermediate ring 14 in inward direction, a contact area between the film and the intermediate ring 14 is formed in a radially inwardly offset position, and this contact area causes excessive sealing material to be squeezed-out inwardly between the film 12 and the intermediate ring 14. Thus, the sealing material is prevented from being accumulated and forming a bulge in this position, so that the bond is weakened in this position.

Figure 8:
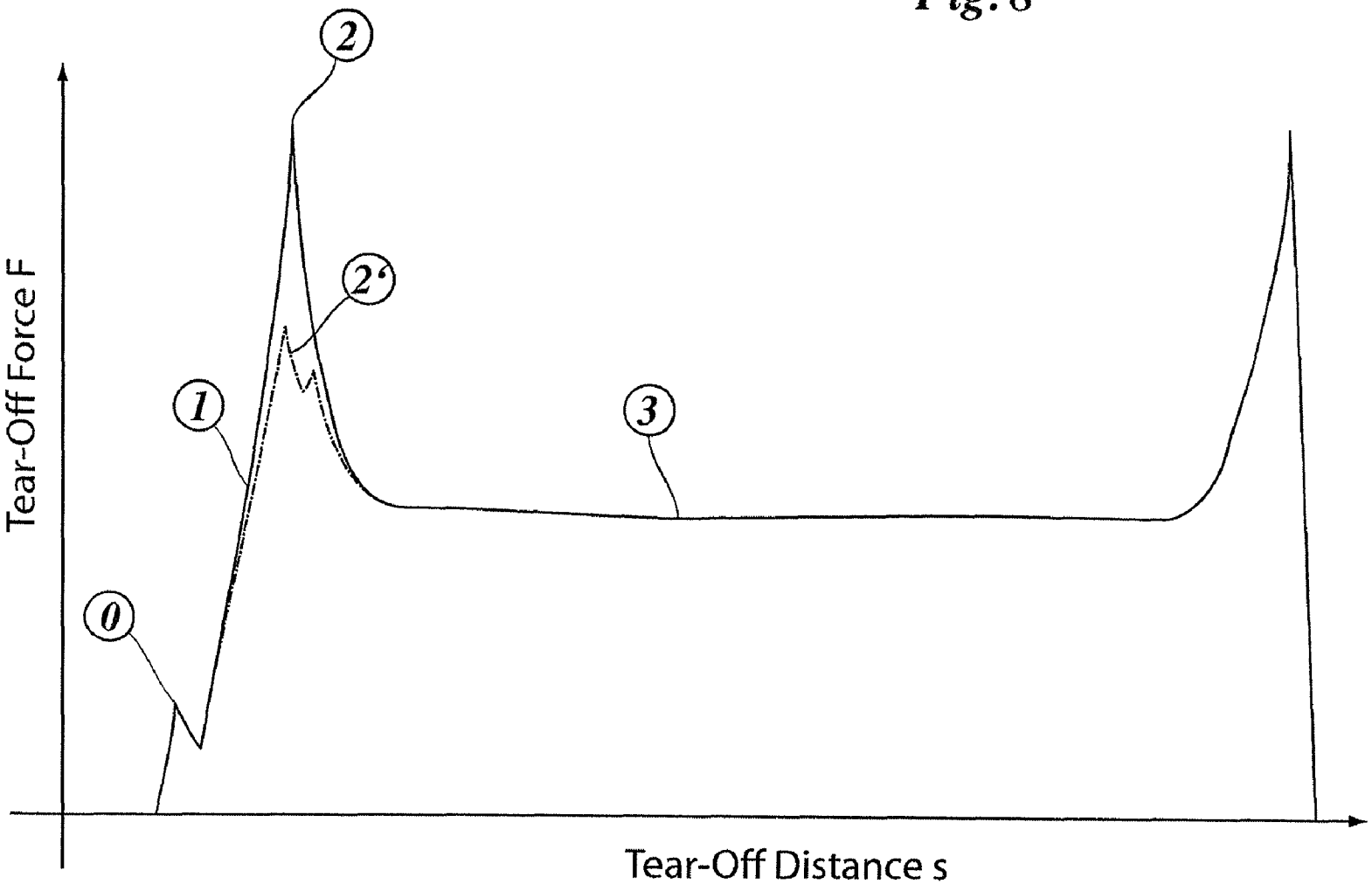
FIG. 8 is a diagram illustrating the forces that occur when the sealed seam that has been formed in accordance with the method according to the invention is torn-off.

The diagram shown in FIG. 8 illustrates the reduction of the maximum tear-off force. The tear-off force F has been shown as a function of the tear-off distance s. While, in a conventional sealed seam, the peak of the force is reached at the point designated as 2, the invention permits to significantly reduce this force as indicated by the peak 2'. According to the invention, this is achieved by weakening the sealed seam 28 at the internal peripheral edge 30, as has been explained above in conjunction with FIGS. 3 and 4.

The invention claimed is:

1. A method of forming a sealed seam between a tear-off film that is provided with a tear-off strip, and a packaging member, the method comprising:

at least one sealing step of compressing the packaging member and the film between a lower die supporting the packaging member and an upper die such that an annular sealed seam is formed in peripheral portions of the film and the packaging member, one of partly destroying and weakening the sealing seam at an internal peripheral edge thereof in the vicinity of the tear-off strip one of:

during one said sealing step, and in a subsequent non-sealing step, and the step of one of partly destroying and weakening including the step of one of lifting and bulging away the film from the packaging member in an internal peripheral portion of the sealing seam one of:

during one said sealing step, and after one said sealing step.

2. The method according to claim 1, wherein the step of one of lifting and bulging includes the step of exerting a mechanical pressure onto a bottom side of the film.

3. The method according to claim 2, wherein the step of exerting a mechanical pressure includes the step of applying mechanical pressure by a plunger provided in the lower die.

4. The method according to claim 3, wherein the step of applying mechanical pressure by a plunger includes the step of arranging the plunger to be movable in the lower die and to be lifted towards the upper die by a lift mechanism.

5. The method according to claim 3, wherein the plunger is fixed in the lower die.

6. The method according to claim 2, wherein the step of exerting a mechanical pressure includes the step of applying one of:

a high gas pressure to a bottom side of the film, and a low gas pressure to a top side of the film.

7. An apparatus for sealing a tear-off film onto a packaging member, comprising:

a lower die for supporting the packaging member, an upper die arranged relative to the lower die such that the lower die and the upper die are axially movable relative to one another for pressing the film and the packaging member one against the other to form a sealing seam thereat, and a plunger formed in the lower die and adapted to be pressed against the film in a vicinity of an internal peripheral edge of a die surface of the lower die in order to one of partly destroy and weaken the sealing seam at the internal peripheral edge thereof by one of lifting and bulging away the film from the packaging member in the internal peripheral portion of the sealing seam one of:

during sealing the tear-off film onto the packaging member when the film and packaging member are pressed one against the other, and in a subsequent step after said sealing.

8. The apparatus according to claim 7, wherein the plunger is axially movable between a retracted position in which an end thereof is retreated from the lower die surface and an extended position in which said end projects beyond the lower die surface towards the upper die, and further comprising a drive mechanism for moving the plunger relative to the lower die.

9. The apparatus according to claim 7, wherein the plunger is stationary and an end thereof projects beyond the lower die surface towards the upper die.

10. The apparatus according to claim 7, wherein the upper die is provided with a recess at an internal peripheral edge of an upper die surface thereof.

11. An apparatus for sealing a tear-off film onto a packaging member, comprising:

a lower die for supporting the packaging member, an upper die arranged relative to the lower die such that the lower die and the upper die are axially movable relative to one another for pressing the film and the packaging member one against the other to form a sealing seam thereat, and a plunger formed in one of the dies at a position inwardly of the sealing seam, and adapted to be pressed against only the film in a vicinity of an internal peripheral edge of a die surface of the lower die in order to one of partly destroy and weaken the sealing seam at the internal peripheral edge thereof by one of lifting and bulging away the film from the packaging member in the internal peripheral portion of the sealing seam one of:

during sealing the tear-off film onto the packaging member when the film and packaging member are pressed one against the other, and in a subsequent step after said sealing.

* * * * *